US008510975B2

(12) United States Patent
Krikelis

(10) Patent No.: US 8,510,975 B2
(45) Date of Patent: Aug. 20, 2013

(54) FOLDABLE FOOTWEAR

(76) Inventor: Sotiria Krikelis, Astoria, NY (US)

( * ) Notice: Subject to any disclaimer, the term of this patent is extended or adjusted under 35 U.S.C. 154(b) by 446 days.

(21) Appl. No.: 12/718,906

(22) Filed: Mar. 5, 2010

(65) Prior Publication Data

US 2011/0214312 A1 Sep. 8, 2011

(51) Int. Cl.
*A43B 3/12* (2006.01)
*A43B 1/10* (2006.01)

(52) U.S. Cl.
USPC ..... 36/102; 36/103

(58) Field of Classification Search
USPC ..... 36/102, 9 R, 88, 93, 71, 43, 103
See application file for complete search history.

(56) References Cited

U.S. PATENT DOCUMENTS

| | | | | |
|---|---|---|---|---|
| 905,432 | A | 12/1908 | Jennings | |
| 2,252,315 | A | 8/1941 | Doree | |
| 2,490,916 | A | 12/1949 | Miller | |
| 3,148,378 | A | 9/1964 | Tibbitts | |
| 3,762,075 | A | 10/1973 | Munschy | |
| 5,127,170 | A | 7/1992 | Messina | |
| 6,836,976 | B2 | 1/2005 | Haugland | |
| 7,032,327 | B1 | 4/2006 | Tartaglia et al. | |
| 7,162,813 | B2 | 1/2007 | Haft | |
| 7,168,190 | B1 | 1/2007 | Gillespie | |
| 7,284,341 | B2 * | 10/2007 | Moseley | 36/11.5 |
| 7,448,148 | B2 | 11/2008 | Martinez et al. | |
| D610,785 | S * | 3/2010 | Smith | D2/947 |
| 7,694,435 | B1 * | 4/2010 | Kiser et al. | 36/11.5 |
| 7,743,529 | B2 * | 6/2010 | Thompson | 36/3 R |
| 8,024,872 | B2 * | 9/2011 | Pettis | 36/73 |
| 2006/0096124 | A1 | 5/2006 | Moseley | |
| 2006/0156576 | A1 | 7/2006 | Sloan | |
| 2007/0204483 | A1 | 9/2007 | Kirsch et al. | |
| 2010/0018080 | A1 * | 1/2010 | Smith | 36/102 |

FOREIGN PATENT DOCUMENTS

| | | |
|---|---|---|
| WO | WO 2008/093035 | 8/2008 |

* cited by examiner

*Primary Examiner* — Jila M Mohandesi
(74) *Attorney, Agent, or Firm* — Orrick Herrington & Sutcliffe, LLP

(57) ABSTRACT

A foldable footwear for easy storage, comprising an upper; an insole having a top surface and a bottom surface; the insole defining a first folding member comprising a U-shaped indentation in the top surface; a padding layer positioned on the top surface of the insole; and an outsole attached to the bottom surface of the insole and the upper, the outsole defining a second folding member, wherein the first and second folding members are positioned at an approximate middle section of the footwear and act together to ease folding of the footwear.

8 Claims, 7 Drawing Sheets

FOLDABLE FOOTWEAR

CROSS-REFERENCE TO RELATED APPLICATIONS

None.

BACKGROUND

High heels are often worn by women at social events as well as business events and gatherings. In many instances, women who want to maintain their fashionable attire opt for high heels for a flattering appearance. Prolonged periods of high-heel wearing, however, can lead to many health-related foot issues, including a condition known as bunions. This occurs when the bone on the big toe is pushed toward the second toe and thrown out of alignment. If bunions are allowed to develop, several difficulties can result. In addition to potential pain caused by the structural deformity of the bones and the joint, the misshape of the foot can lead to problems in the purchase of future shoes. Maintaining heels on the foot not only causes health-related issues but it is also very painful on the ball and the heel of the foot due to a lack of support and cushioning.

In anticipation of foot pain caused by heels, some women bring along an extra pair of footwear with them so that they can change out of their heels. However, these extra shoes do not fold and are bulky so they cannot easily be carried in women's handbags for an immediate slip-on. These extra shoes take up enormous space in the bag and are not practical to carry everyday. In other instances, when a change of shoes is not available, some may opt to go barefoot, which is not a very desirable option. Walking barefoot, whether driving or walking or in the office, can be unsafe as well as inappropriate.

Therefore, there is a need for shoes that can be easily reduced in size for storage and carried in a small space, but that can be worn comfortably during various activities throughout the day.

SUMMARY

The various embodiments and examples provided here in described herein relate generally to footwear that may be readily folded into a thin or compact package to allow for storage during transportation.

Embodiments of the invention described herein allow women to replace their high heels with portable and comfortable footwear such as flats that have sufficient room in the toe portion for the toes to expand as well as adequate cushioning for the ball and the heel of the foot. According to an embodiment of the invention, a pair of flexible shoes can be folded, and can be conveniently and discreetly placed in a small handbag for a woman user to carry on the go. When the user decides to change out of her uncomfortable shoes to relax her feet, the flexible shoes can be unfolded to their normal shoe state. The foldable shoes can then act as a substitute for the uncomfortable footwear from which the user has developed sore feet after prolonged wear.

In one embodiment, the shoe comprises an upper, an insole, a padding layer, and an outsole. The insole has a top surface and a bottom surface, and defines a first folding member comprising a U-shaped indentation across the top surface. The outsole is attached to the bottom surface of the insole and the upper, and defines a second folding member comprising an inverted U-shaped indentation across the outsole's bottom surface. The first and second folding members are positioned approximately at the center of the shoe and act together to ease the folding of the shoe.

According to another embodiment, the shoe comprises an upper, an insole, a padding, and an outsole. Like the previous embodiment, the insole has a top surface and a bottom surface, and defines a first folding member comprising a U-shaped indentation across the top surface. The outsole is attached to the bottom surface of the insole and the upper, and defines a second folding member comprising two slits on the bottom surface, with spacing between the two slits at about a quarter of an inch wide. The first and second folding members are positioned approximately at the center of the shoe and act together to ease the folding of the shoe. This allows the outsole to bend in half and then return to its original shape in the normal extended version. When the shoe is folded, the outsole bends at the two slits and in turn allows the heel and toe portion to fold together. In the folded state, the slits become more prominent, splitting the outsole into two large portions and a small middle portion.

Other objects and features of the present invention will become apparent from consideration of the following description taken in conjunction with the accompanying drawings.

BRIEF DESCRIPTION OF THE DRAWINGS

Features of the present invention will become apparent from the following detailed description considered in connection with the accompanying drawings. It is to be understood, however, that the drawings are designed as an illustration only and not as a definition of the limits of the invention. The components in the figures are not necessarily to scale, emphasis instead being placed upon illustrating the principles of the invention. Moreover, all illustrations are intended to convey concepts, where relative sizes, shapes and other detailed attributed may be illustrated schematically rather than literally or precisely.

In the drawings, wherein similar reference numerals denote similar elements throughout the several views.

DETAILED DESCRIPTION OF A PREFERRED EMBODIMENT

Each of the features and the teachings disclosed below can be utilized separately or in conjunction with other features and teachings to provide footwear that may be readily folded into a thin or compact package to allow for storage during transportation. Representative examples of the present invention utilizing many of the additional features and teachings both separately and in combination, will now be described in further detail with reference to the attached features. This detailed description is merely intended to teach a person of skill in the art further details for practicing preferred aspects of the present teachings and is not intended to limit the scope of the invention.

Figure 1:
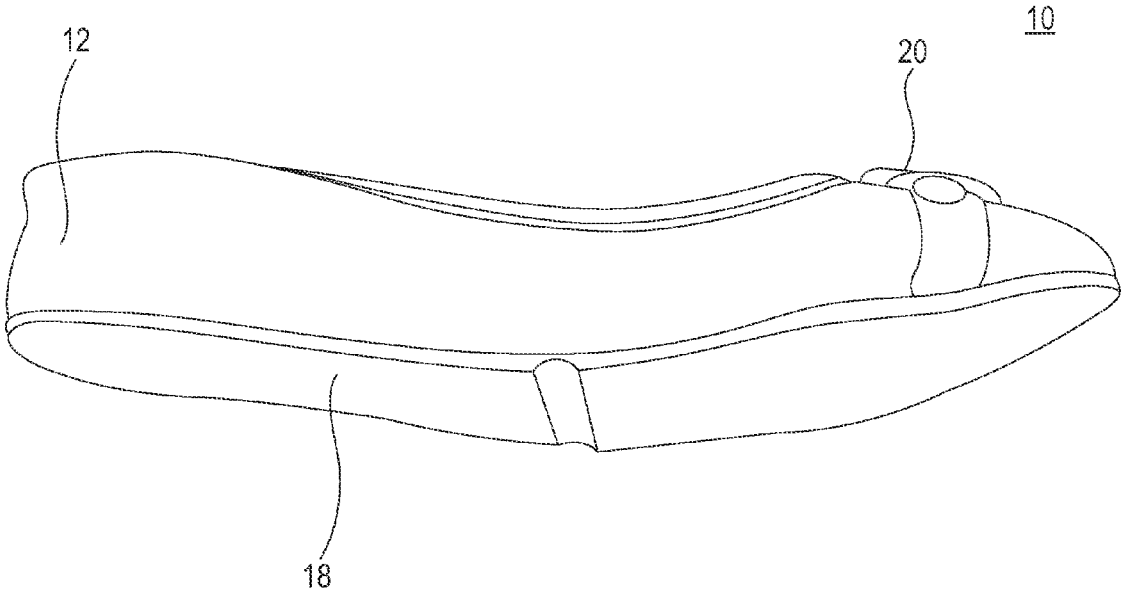
FIG. 1 is a side view of a footwear according to one embodiment of the invention.
Figure 1A:
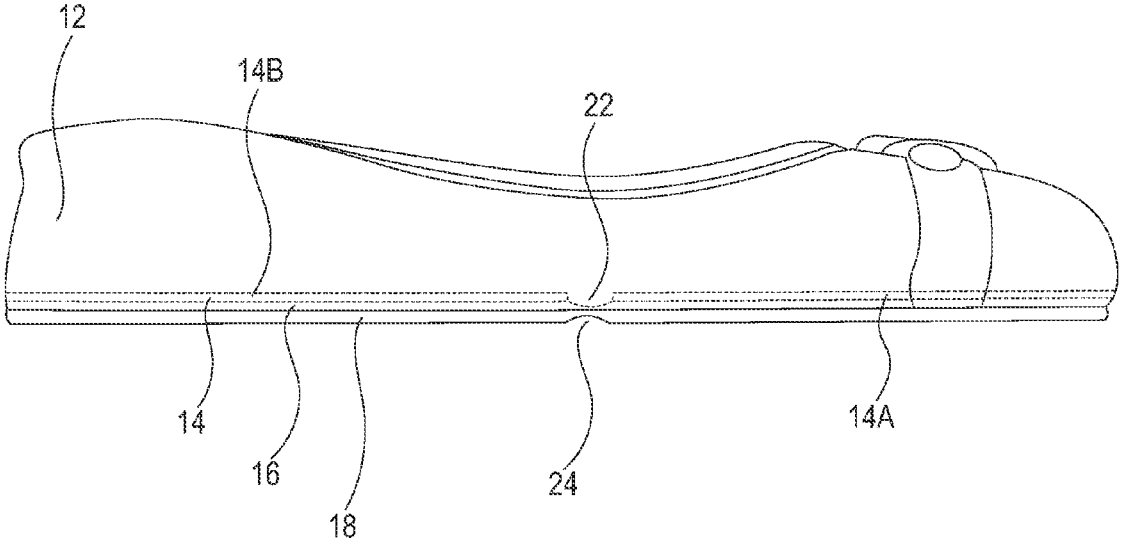
FIG. 1A is a schematic side view of the footwear shown in FIG. 1.

Referring now in detail to the drawings, an exemplary embodiment of the present invention is shown in the figures as a foldable shoe that can be customized in size and shape. As illustrated in FIG. 1 and FIG. 1A, the shoe 10 comprises an upper 12, an insole 16, a padding layer 14, and an outsole 18.

Figure 2:
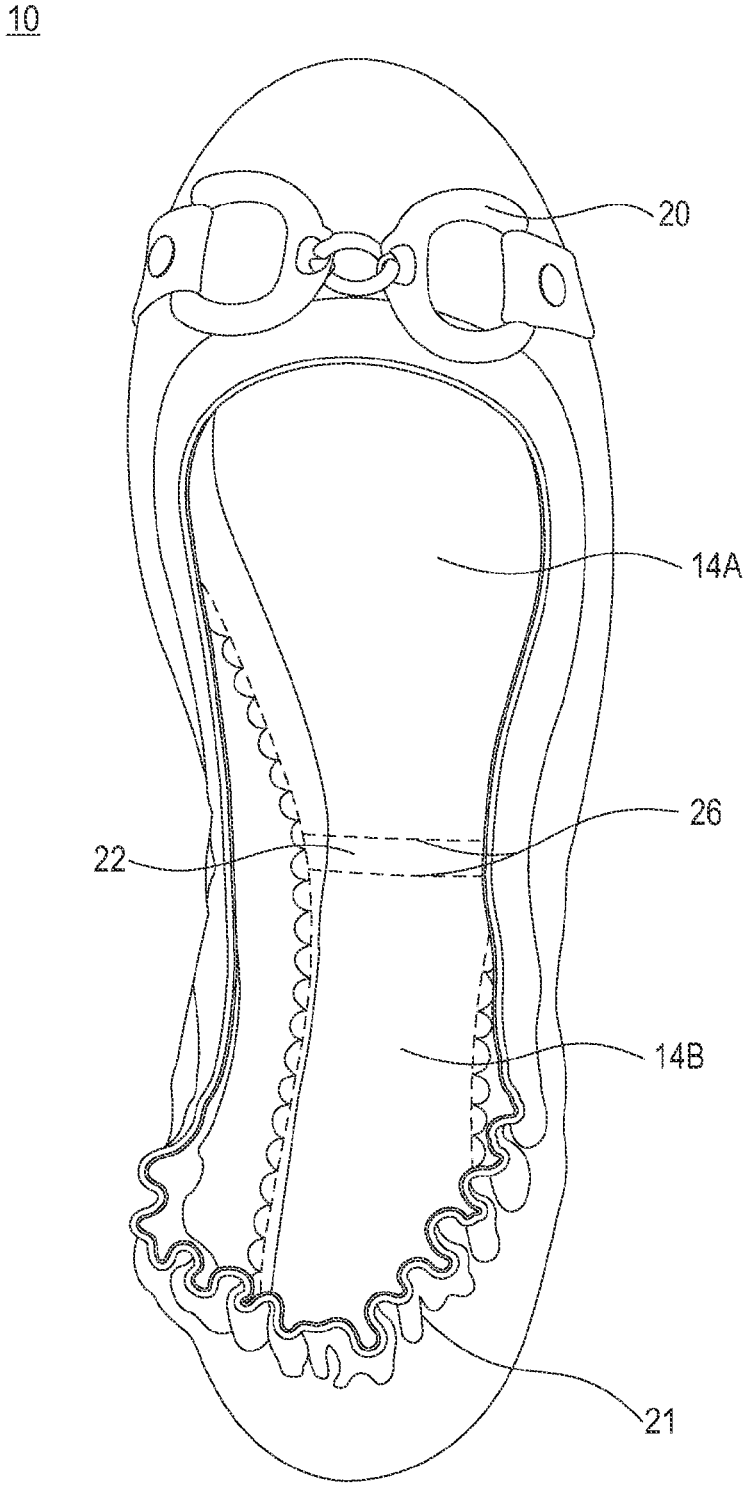
FIG. 2 is a top view of a footwear according to one embodiment of the invention.

The upper 12 is a layer of fabric or otherwise-flexible material that covers the foot, and can be coupled to the insole and the outsole (e.g., by stitching, hammering, or gluing) at the perimeter of the shoe. It can be made out of canvas, plastic, suede, leather, and/or other materials that vary in breathability, and can include or attach decorative design elements such as buckles 20, as shown in FIG. 1 and FIG. 2. The upper 12 can also include an elastic heel portion 21 to more easily accommodate the insertion of a user's foot into the shoe, as illustrated in FIG. 2.

Referring to FIG. 1A, the insole 16 has a top surface and a bottom surface, and defines a first folding member 22 comprising a U-shaped indentation across the top surface. The padding layer 14 sits on top of the insole 16 and can be attached to the insole 16. According to a preferred embodiment, the padding layer 14 can comprise two separate pieces, 14*a*, 14*b*, and can be stitched on or otherwise attached to the insole of the shoe. As shown in FIG. 2, the stitching 26 across the middle of the shoe coincides with the location of the first folding member 22 on the insole, such that the cushioning of the padding layer 14*a*, 14*b* is placed on top of the insole at the toe portion and the heel portion of the shoe, but not the middle. Thus, extra cushioning is provided at the toe and heel portions of the shoe (where it is needed the most), and the lack of cushioning at the center of the shoe (i.e., location of the first folding member 22) allows the shoe to fold more easily.

Figure 3:
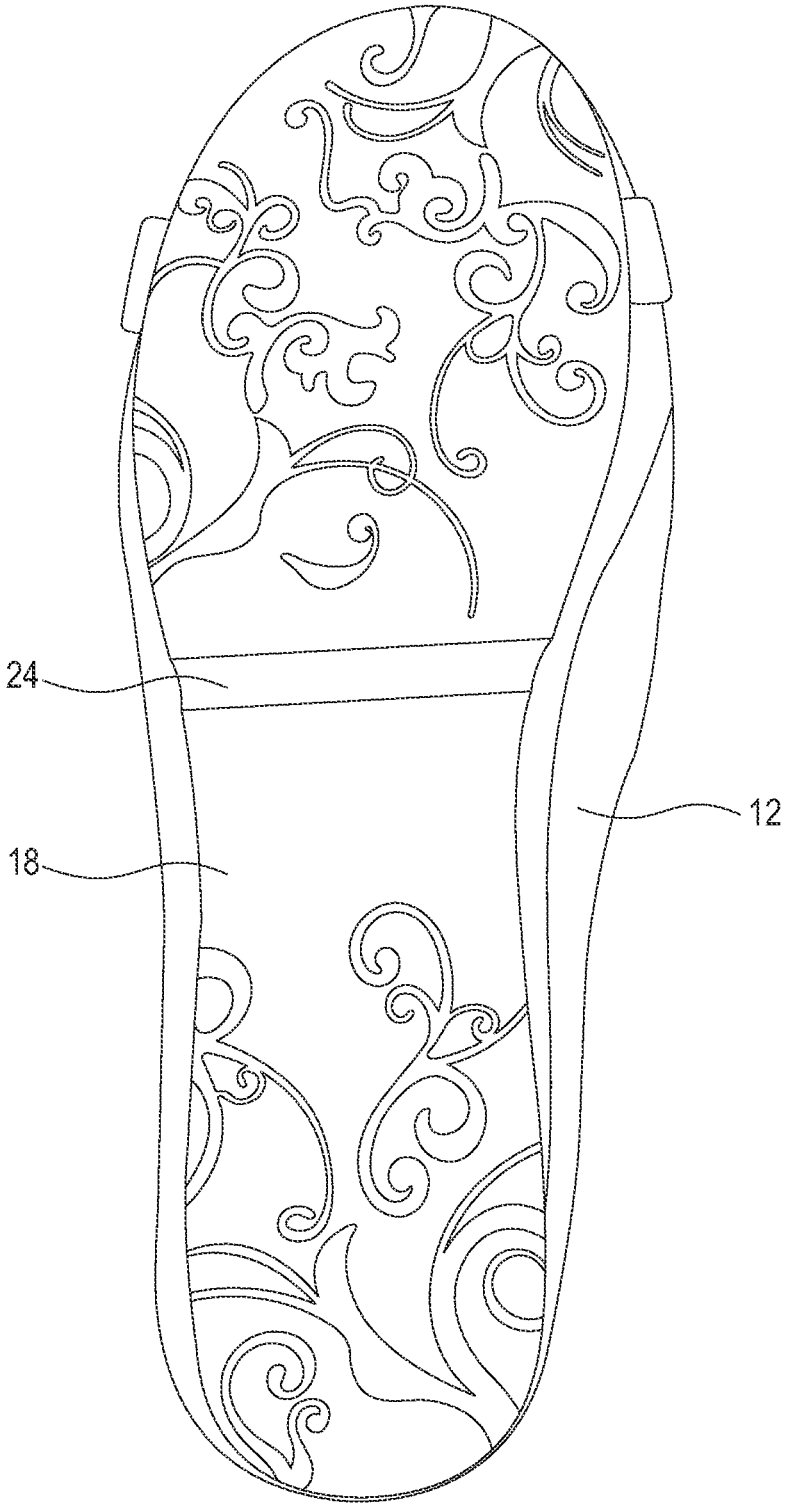
FIG. 3 is a bottom view of a footwear according to one embodiment of the invention.

The outsole 18, located on the bottom of the shoe 10, is attached to the bottom surface of the insole 16 and coupled to the upper 12 at the perimeter of the shoe. The outsole 18 defines a second folding member 24 comprising an inverted U-shaped indentation across the outsole's bottom surface. The first and second folding members 22, 24 are positioned approximately at the center of the shoe and act together to ease the folding of the shoe 10. As shown in FIG. 3, the bottom surface of the outsole 18 has an indentation 24 across the center of the shoe, and can include various designs and textures on the heel and toe portions.

Figure 4:
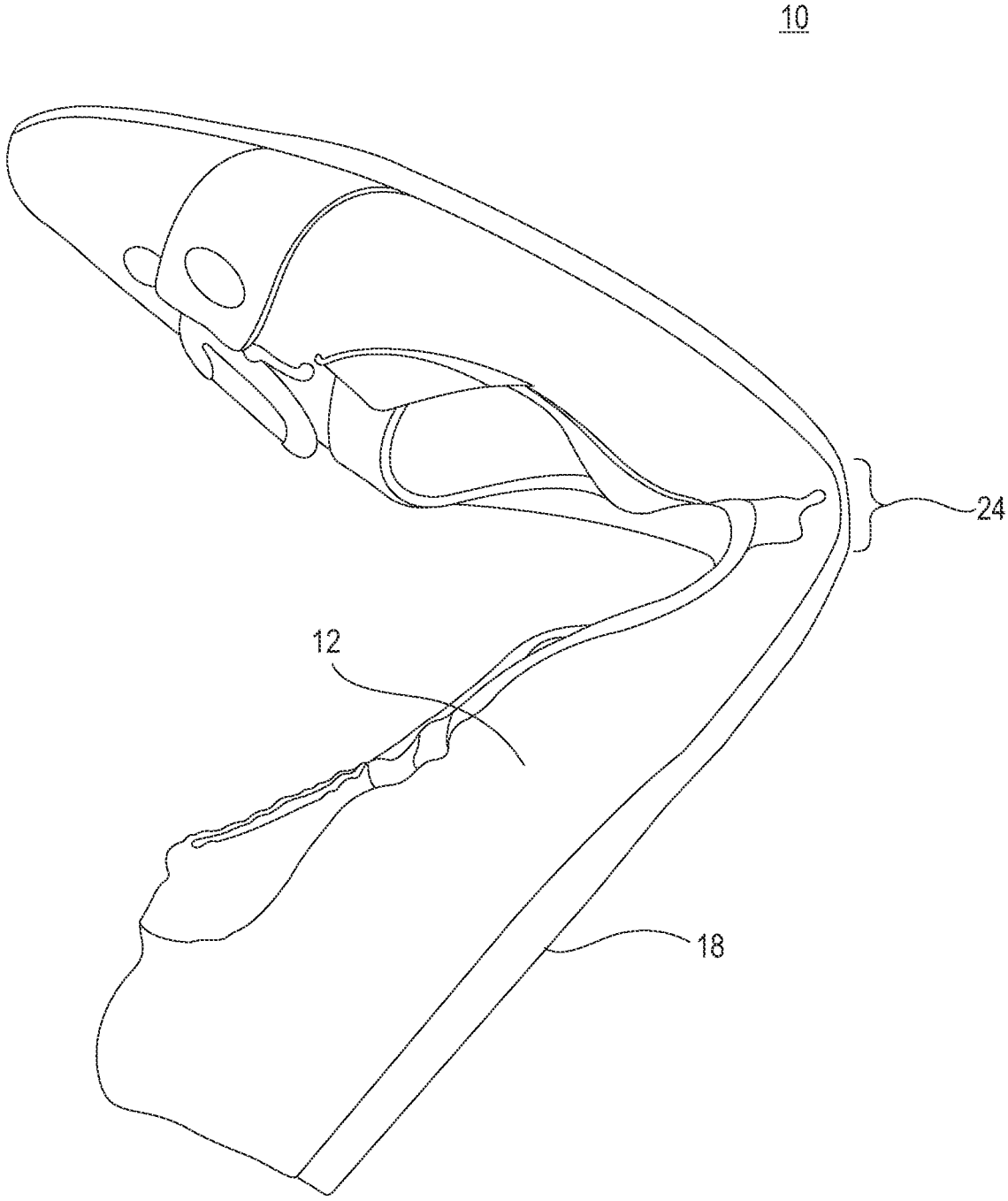
FIG. 4 is a side view of a footwear in a partially-folded state according to one embodiment of the invention.

FIG. 4 shows an embodiment of the present invention in a partially-folded state. According to this embodiment, the shoe 10 can be folded approximately at the center, where the first and second folding members 22, 24 are located. Both the insole 16 and the outsole 18 have a thinned region in the middle (in contrast to the thicker toe and heel regions) to facilitate the folding of the shoe. At the same time, the upper 12 is made of a flexible fabric so that the folding of the shoe does not permanently distort the shape of the shoe.

Figure 5:
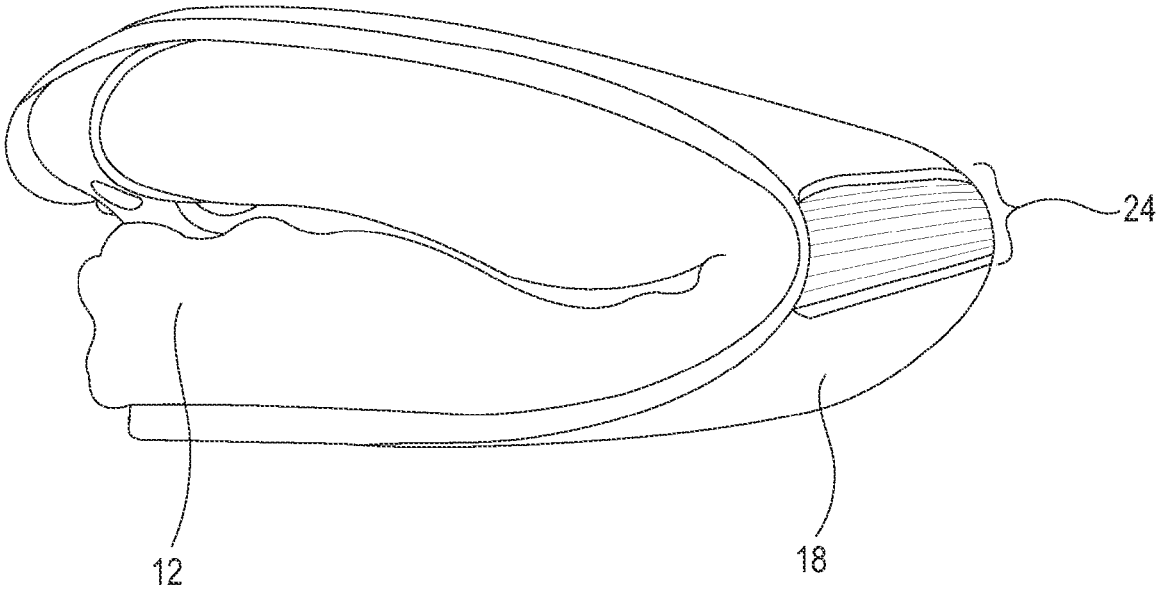
FIG. 5 is a side view a footwear in a fully-folded state according to one embodiment of the invention.

FIG. 5 shows an embodiment of the present invention in a fully-folded state. As shown in the figure, the shoe 10 can be folded over itself such that the toe and the heel portions of the upper 12 are stacked directly on top of each other. The outsole 18 faces out and becomes both the top surface and the bottom surface of the folded shoe, effectively sandwiching the upper 12 in the middle. In this fully-folded state, the size of shoe 10 is significantly reduced, which enables the user to carry a pair of such shoes more easily in a small space. According to a preferred embodiment, the shoes, when in a fully-folded state, can fit into a small bag with dimensions of approximately 7 inches long and 5 inches wide.

Figure 7:
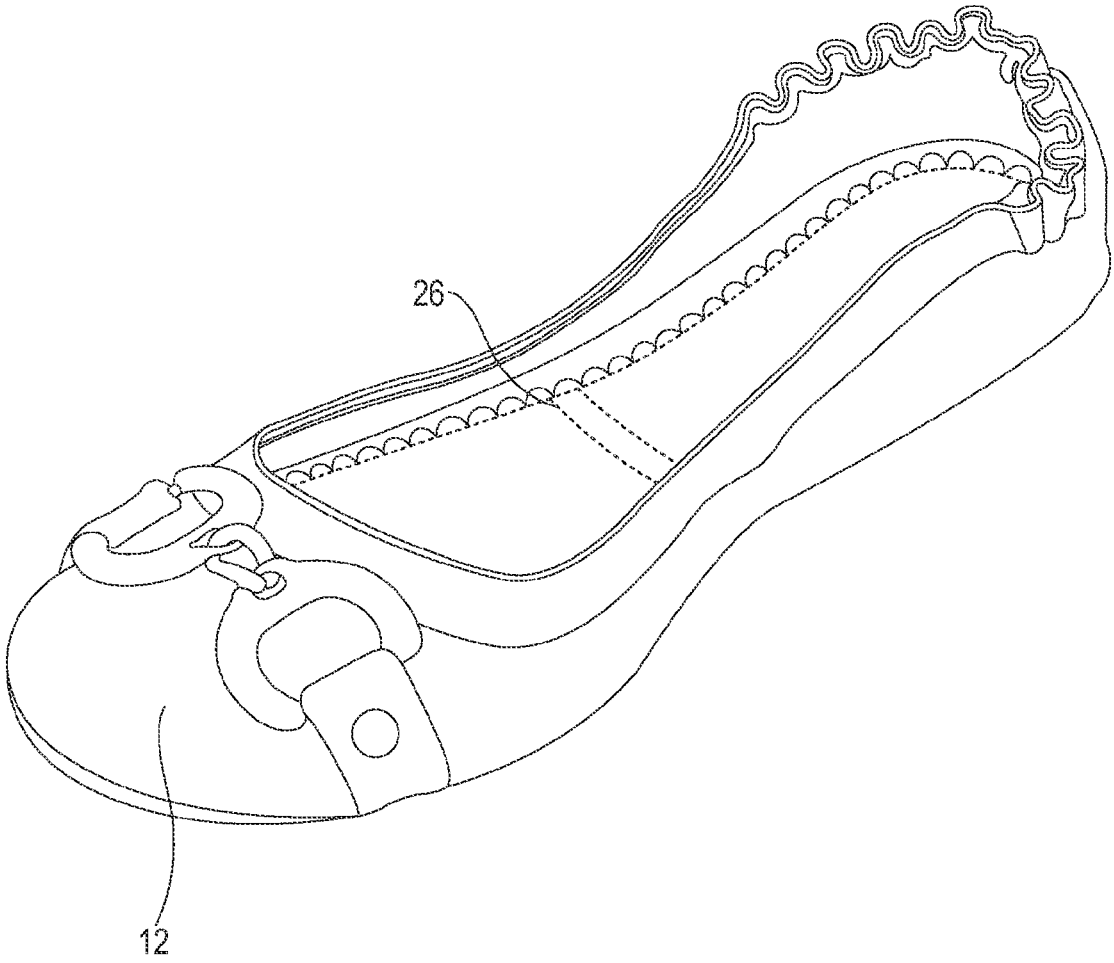
FIG. 7 is a frontal perspective view of a footwear according to one embodiment of the invention.

When unfolded, the shoe 10 is restored to its original shape and can be worn by the user in its normal state. A frontal perspective view of a shoe in its normal state, according to one embodiment of the invention, is shown in FIG. 7.

Figure 6:
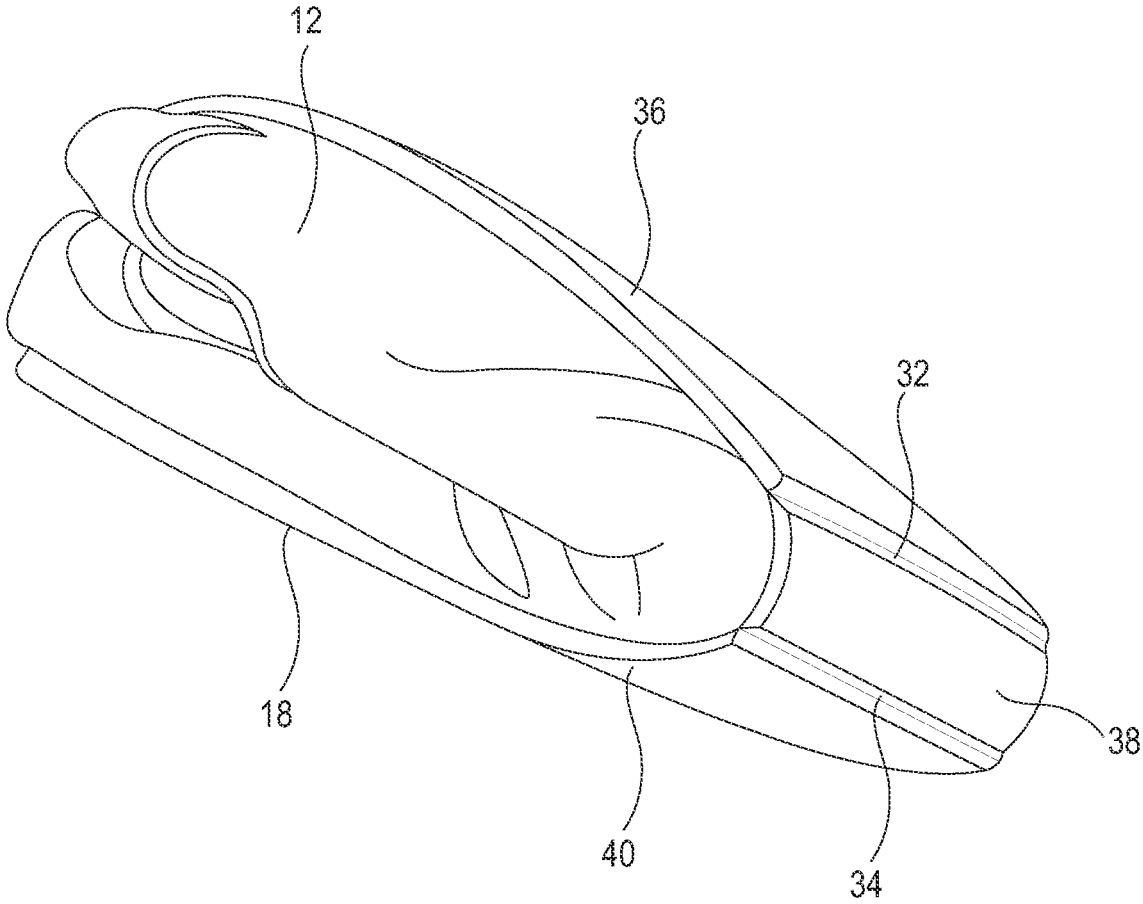
FIG. 6 is a side view of a footwear in a fully-folded state according to a second embodiment of the invention.

According to an alternative embodiment, the shoe similarly comprises an upper 12, an insole 16, a padding layer 14, and an outsole 18, but includes one or more folding members configured in a different fashion. In a variation of the present invention illustrated in FIG. 6, the outsole 18 is attached to the bottom surface of the insole 16 (not shown) along with the upper 12, and defines a folding member comprising two slits 32, 34 across the bottom surface, with some spacing between the two slits (e.g., at about a quarter of an inch wide). In a folded state, the slits 32, 34 become more prominent and the outsole can be seen as divided into three major portions: the toe portion 36, the heel portion 40, and the middle portion 38.

The depth of the slits 32, 34 can extend through the entire thickness of the outsole 18 or through a partial thickness of the outsole 18. If the slit depth extends the entire thickness of the outsole, a strip of material (e.g., made of leather) can be inserted and coupled in between the insole 16 and the outsole 18 for cosmetic purposes so that the insole 16 is not visible at the slits 32, 34 when the shoe is in a folded state. In another embodiment (not shown), the outsole in the middle portion 38 between the two slits 32, 34 can be removed altogether and so the layer facing out when the shoe is in a folded position is a strip of material (e.g., made of leather) attached to the insole or the bottom side of the insole itself.

In one embodiment, the insole 16 can define a folding member comprising a U-shaped indentation across the top surface. Instead of a U-shaped indentation, however, the folding member on the insole can also have different shapes that are thinned out at or near the center, to promote the folding of the shoe in conjunction with the double slits 32, 34 on the outsole. The two folding members on the insole and the outsole are positioned approximately at the center of the shoe and act together to ease the folding of the shoe. This allows the outsole to bend in half and then return to its original shape in the normal extended version. When the shoe is folded, the outsole bends at the two slits 32, 34 and in turn allows the heel and toe portion to fold together. In the folded state, the slits 32, 34 become more prominent, splitting the outsole into two large portions 36, 40 and a small middle portion 38.

It is understood that the shape of the folding members defined on the insole and the outsole can vary, such that they ease the folding of the shoe, within the scope of this invention and its associated claims. It is also understood that while this disclosure refers to and illustrates at times, a shoe in the fashion of a woman's ballerina flat, that in fact the footwear used in connection with this invention are more broadly defined, including other types of footwear suitable for both men and women that would achieve the desired functionalities imparted by the folding members in the insole and the outsole.

While the invention is susceptible to various modifications and alternative forms, specific examples thereof have been shown in the drawings and are herein described in detail. It should be understood, however, that the invention is not to be limited to the particular form disclosed, but to the contrary, the invention is to cover all modifications, equivalents, and alternatives falling within the spirit of the appended claims.

What is claimed is:

1. A foldable footwear for easy storage, comprising:

an upper;

an insole having a top surface and a bottom surface, the insole defining a first folding member comprising a U-shaped indentation in the top surface of the insole;

a padding layer positioned on the top surface of the insole; and an outsole attached to the bottom surface of the insole and the upper, the outsole defining a second folding member, wherein the second folding member comprises an inverted U-shaped indentation in a bottom surface of the outsole;

wherein the first folding member is positioned on top of the second folding member; and wherein the first and second folding members are positioned midway between a toe portion and a heel portion of the footwear and enable the footwear to fold in half such that the toe portion touches the heel portion when folded.

2. The footwear of claim 1 wherein the second folding member comprises two slits across a bottom surface of the outsole.

3. The footwear of claim 2 wherein the two slits define a distance therebetween of about a quarter of an inch.

4. The footwear of claim 2 wherein the two slits extend all the way through the outsole in depth wherein a portion of the insole is exposed.

5. The footwear of claim 2 wherein the two slits extend through a portion of the outsole in depth but do not extend all the way through the outsole.

6. The footwear of claim 1 wherein the padding layer comprises two separate cushioning pieces coupled to the insole at a toe portion and a heel portion of the insole, respectively.

7. A method to carry footwear in a reduced space, comprising:

folding a flexible shoe in half, the shoe comprising an insole defining a first folding member comprising a U-shaped indentation across a top surface of the insole, and an outsole coupled to the insole, the outsole defining a second folding member comprising an inverted U-shaped indentation across a bottom surface of the outsole, wherein the second folding member comprises an inverted U-shaped indentation across a bottom surface of the outsole, wherein the first folding members is positioned on top of the second folding member midway between a toe portion and a heel portion of the footwear and enable the footwear to fold in half such that the toe portion is positioned adjacent to and parallel with the heel portion in a folded position; and storing the flexible shoe in its folded state in a container designed to accommodate a pair of the flexible shoes in its reduced size.

8. The footwear of claim 1, wherein the U-shaped indentation does not extend through an entire thickness of the insole and the inverted U-shaped indentation does not extend through an entire thickness of the outsole.

* * * * *